US006074260A

United States Patent [19]

Harris et al.

[11] Patent Number: 6,074,260

[45] Date of Patent: Jun. 13, 2000

[54] LIFERAFTS

[75] Inventors: Anthony Roy Harris, Kingsbridge; Thomas George Scott, Belfast; Mark Magee, Dunmurry, all of United Kingdom

[73] Assignee: Wardle Storeys (Safety & Survival Equipment) Limited, United Kingdom

[21] Appl. No.: 09/038,543

[22] Filed: Mar. 11, 1998

Related U.S. Application Data

[63] Continuation of application No. PCT/GB96/02265, Sep. 12, 1996.

[30] Foreign Application Priority Data

Sep. 14, 1995 [GB] United Kingdom ..... 9518816

[51] Int. Cl.[7] ..... B63B 35/58

[52] U.S. Cl. ..... 441/40; 114/345

[58] Field of Search ..... 441/38, 39, 40, 441/44, 45; 114/345

[56] References Cited

U.S. PATENT DOCUMENTS

| | | | |
|---|---|---|---|
| 3,037,218 | 6/1962 | Brooks, III | 9/11 |
| 3,072,930 | 1/1963 | Fraebel | 441/38 |
| 3,092,854 | 6/1963 | Manhart | 441/38 |
| 3,685,066 | 8/1972 | Edwards . | |
| 4,001,905 | 1/1977 | Givens . | |
| 4,267,614 | 5/1981 | Anderson . | |
| 4,517,914 | 5/1985 | Geracitano | 114/345 |
| 5,397,258 | 3/1995 | Switlik et al. | 441/40 |

FOREIGN PATENT DOCUMENTS

| | | |
|---|---|---|
| 44902/68 | 9/1973 | Australia . |
| 0 274 570 | 7/1988 | European Pat. Off. . |
| 147656 | 7/1920 | United Kingdom . |
| 926555 | 12/1971 | United Kingdom . |
| 2052398 | 1/1981 | United Kingdom . |
| 2060509 | 5/1981 | United Kingdom . |

*Primary Examiner*—Jesus D. Sotelo
*Attorney, Agent, or Firm*—Fields and Johnson, P.C.

[57] ABSTRACT

A reversible liferaft has an inflatable structure (10, 11, 12, 18, 19, 40) that supports a canopy providing a floor (14) and a roof (15) that lie in parallel planes. This makes the liferaft reversible which is a useful safety feature.

32 Claims, 3 Drawing Sheets

LIFERAFTS

This is a continuation of international application PCT/GB96/02265 filed on Sep. 12, 1996.

The invention relates to liferafts.

A typical liferaft comprises a canopy supported by an inflatable structure. When inflated, the canopy provides a floor on which the occupants can sit and a domed or peaked roof or cover overlying the floor which shelters the occupants.

According to the invention, there is provided a literaft comprising a canopy including two foldable generally planar members interconnected by a wall, the canopy being supported by an inflatable structure which, when inflated, includes inflatable tubes which hold the planar members in such a spaced configuration that one member acts as a floor and the other member acts as a roof, or vice versa, an entrance being provided for access into the interior of the liferaft.

The liferaft is thus reversible and it does not matter which way up the liferaft falls into the water or arrives at the surface from a submerged vessel; it is immediately usable.

The following is a more detailed description of some embodiments of the invention, by way of example, reference being made to the accompanying drawings in which.

The liferafts now to be described with reference to the drawings are described in their inflated condition. It will be appreciated, however, that they can all be deflated and packed away until required for use. In addition, they may include inflation equipment of known kind (although alternative inflation equipment is described below) and may include other ancillary equipment such as stores, rigging lines, etc.

Figure 1:
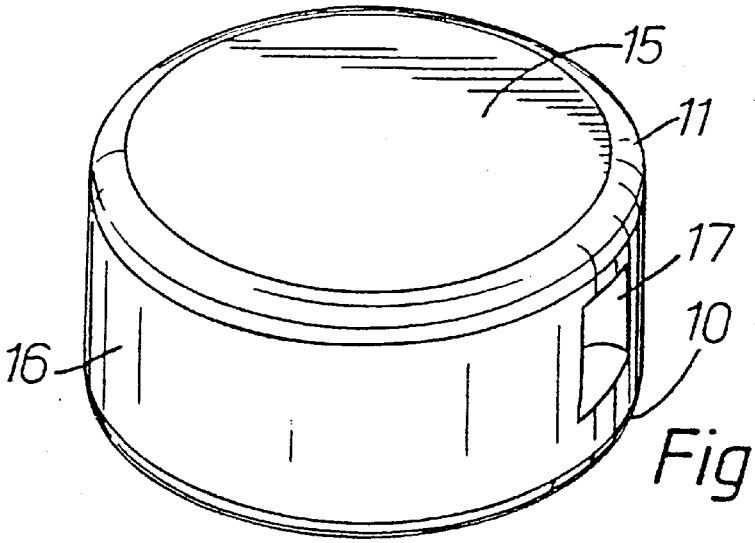
FIG. 1 is a schematic perspective view of a first form of liferaft.
Figure 2:
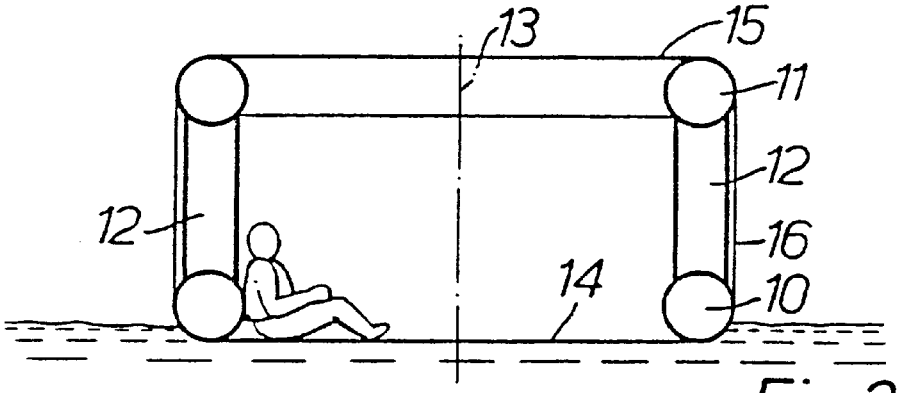
FIG. 2 is a cross section through the liferaft of FIG. 1.

The first form of liferaft shown in FIGS. 1 and 2 comprises first and second circular inflatable tubes 10,11 held parallel to one another by a plurality of inflatable tubular struts 12. As seen in FIG. 2, the tubes 10,11 lie in generally parallel but spaced planes and the struts 12 are angularly spaced around the tubes 10,11 and extend in a direction parallel to the axis 13 of the circles defined by the tubes 10,11.

The tubes 10,11 and the struts 12 are covered by a canopy. This is formed by first and second circular sheets of foldable material 14,15. As shown in FIG. 2, the first sheet 14 forms a floor arid the second sheet 15 forms a roof but, as will be described in more detail below, these functions may be reversed. The sheets 14,15 may be of proofed textile material and may optionally include insulation. The first tube 10 surrounds and is connected to one side of the first sheet 14 and the second tube 11 surrounds and is connected to one side of the second sheet 15. The sheets 14,15 are thus spaced apart by inflatable tubular members 12.

A wall 16 extends between and is connected to the tubes 10,11 and also extends all around the tubes 10,11. As seen in FIG. 1, the wall includes an entrance 17. The wall 16 may be made of the same material as the sheets 14,15.

It will be appreciated that the first liferaft shown in FIGS. 1 and 2 can be deployed with either the first sheet 14 lowermost and forming the floor and the second sheet 15 uppermost and forming the roof or the other way around with the second sheet 15 forming the floor and the first sheet 14 forming the roof. The entrance 17 in the wall 16 allots access to the interior of the liferaft whichever way up it is deployed.

Figure 3:
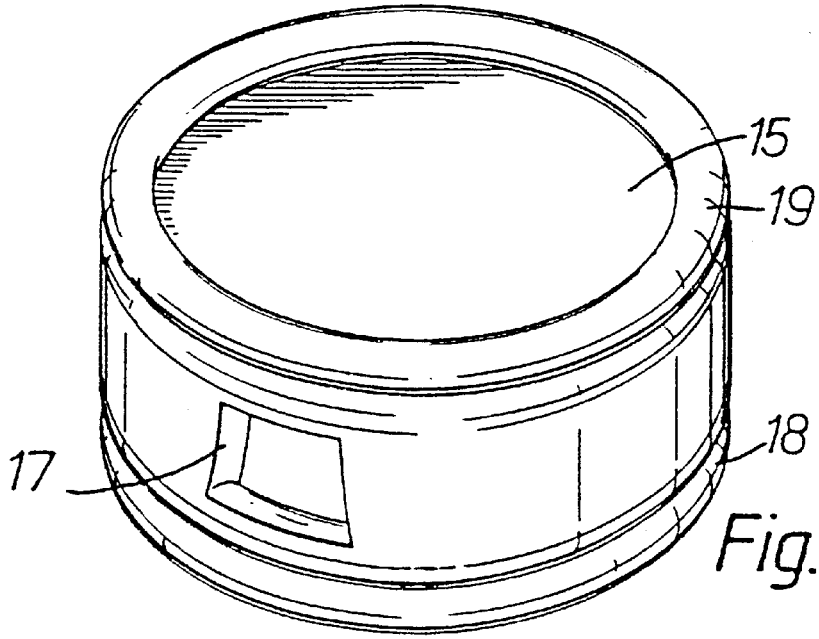
FIG. 3 is a schematic perspective view of a second form of liferaft.
Figure 4:
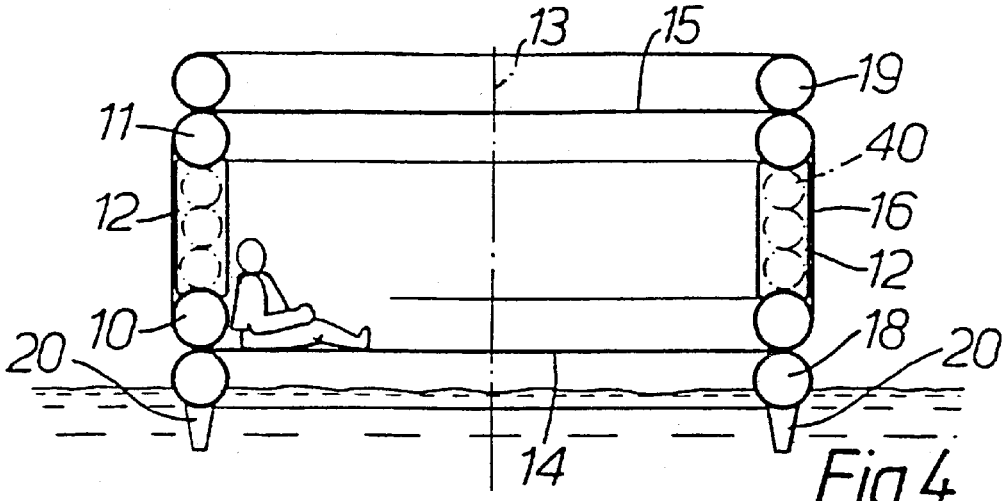
FIG. 4 is a cross-section through the liferaft of FIG. 3.

Referring now to FIGS. 3 and 4, the second form of liferaft is similar to tie first form of liferaft of FIGS. 1 and 2. Parts common to these liferafts will be given the same reference numerals and will not be described in detail.

In the second form of liferaft of FIGS. 2 and 3, third and fourth circular inflatable tubes 18,19 are provided. The third and fourth tubes 18,19 have a circular configuration which is identical to the tubes 10,11.

The third tube 18 is in register with the first tube 10 but is arranged on the other side of the first sheet 14 and is connected to that side of the first sheet 14. The fourth tube 19 is in register with the second tube 11 and is arranged on the other side of the second sheet 15 and is connected to that side of the second sheet 15.

In addition, as seen in the lower part of FIG. 4, the third and fourth tubes 18,19 are each provided with a plurality of water pockets 20. The tube 18,19 that is in the water when the liferaft is deployed has the associated pockets 20 filled with water to stabilize the liferaft.

The presence of the third and fourth tubes 18,19 provides additional buoyancy. As seen in FIG. 4, this can hold the first sheet 14 (or the second sheet 15 if the liferaft is reversed) above the water and this can be more comfortable for the occupants.

Figure 5:
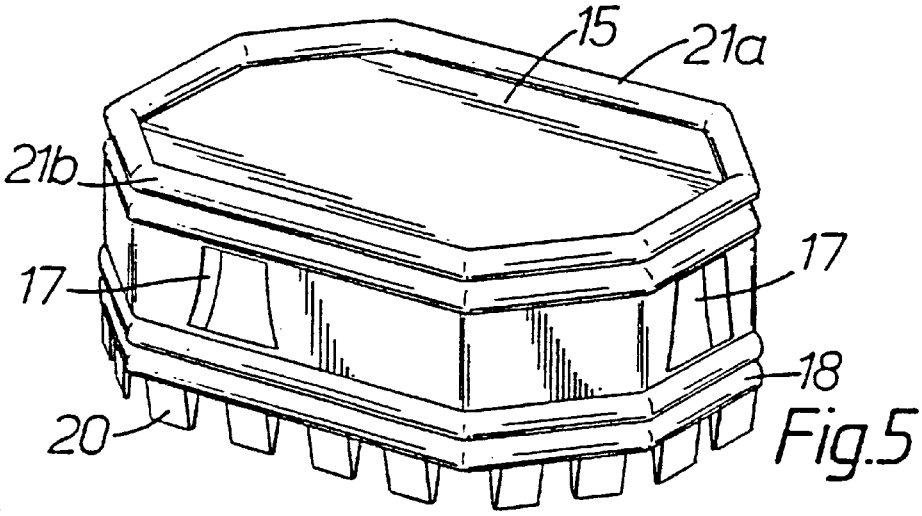
FIG. 5 is a schematic perspective view of a third form of liferaft.

It will be appreciated that the first and second tubes 10,11 and the third and fourth tubes 18,19 need not be formed into a circle and the sheets 14,15 need not be correspondingly shaped. They may be of any shape. One example of this is shown in FIG. 5 where parts common to FIG. 5 and to FIGS. 1 to 4 will be given the same reference numerals and will not be described in detail. The liferaft of FIG. 5 has the first and second tubes 10,11 and the third and fourth tubes 18,19 each in the form of an octagon with two of the sides 21*a*,21*b* being longer than the other sides. The first and second sheets 14,15 and the walls 16 are correspondingly shaped.

Figure 6:
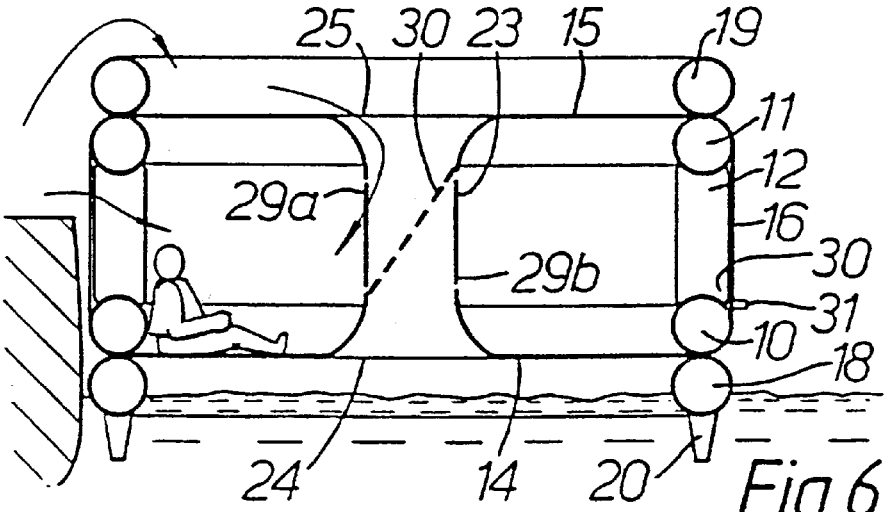
FIG. 6 is a cross-section through a modified form of the liferaft shown in FIGS. 3 and 4 used with a ship of low freeboard.
Figure 7:
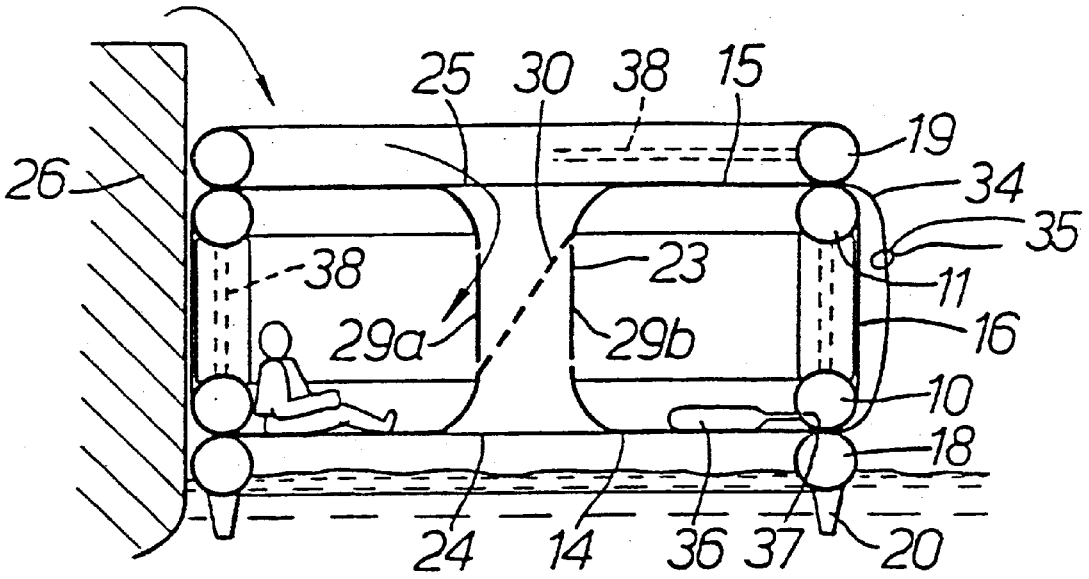
FIG. 7 is a similar views to FIG. 6 but showing a ship of high freeboard.

A variation of the second form of liferaft is shown in FIGS. 6 and 7. Again, the liferaft of these figures has many features in common with the liferaft of FIGS. 3 and 4 and these features will be given the same reference numerals in these figures as they are in FIGS. 3 and 4 and will not be described in detail.

In this liferaft, the variation is that a tube 23 is provided extending between a hole 24 in the first sheet 14 and a hole 25 in the second sheet 15. Thus there is a tube extending from the outer surface of the first sheet 14 to the outer surface of the second sheet 15. The tube 23 includes an entrances 29*a*,29*b* that are arranged on diametrically opposite sides of the tube 23 and are selectively openable and closable to allow access to the interior of the liferaft. A panel 30 extends across the tube 23 intermediate its ends and at an angle transverse to the axis of the tube 23. In the disposition of the liferaft shown in FIGS. 6 and 7, one end of the panel 30 is adjacent a lower end of one entrance 29*a* and the other end of the panel 30 is adjacent an upper end of the other entrance 29*b*. The panel 30 is perforated.

The usefulness of this is illustrated in the figures. As shown, it allows access from the sheet 14 or 15 which forms the roof or cover. Persons evacuating a ship 26 can either pass through the entrance 17 in the wall 16 or they can pass on to the sheet 14,15 forming the roof, then pass into the tube 23. A person dropping down the tube 23 contacts the panel 30 and is diverted through one or other of the entrances 29*a*, 29*b*, depending on which way up the liferaft is disposed. The entrance 29*a*,29*b* not being used may be closed. The fact that the panel 30 is perforate allows water to pass through the panel 30 without being diverted into the liferaft.

If the side entrance 17 is used, there is the possibility of water entering the liferaft as persons clamber through the entrance 17. This problem is alleviated by connecting the wall 16 to the outermost point on the periphery of the tube 10. As seen in FIGS. 6 and 7, this forms a channel 31 into which water can drain as persons clamber into the liferaft. The channel is provided with a drain 32 to return water to the sea.

It may be necessary to connect the liferaft to a similar liferaft in order to accommodate the passengers on a ship. To assist in this, a bridle is provided which includes a vertically arranged rope 34 and an eye 35 slidable on the rope 34 and for connection to another liferaft with the eye 35 sliding along the rope 34 to accommodate relative movement between the liferafts.

As shown in FIG. 6, the entrance 17 may only be usable with the ship 26 of low freeboard. As seen in FIG. 7, if the ship 26 has high freeboard, it may only be possible for evacuees to access the sheet 14,15 forming the roof and then pass through the tube 23 into the interior of the liferaft as described above.

Figure 8:
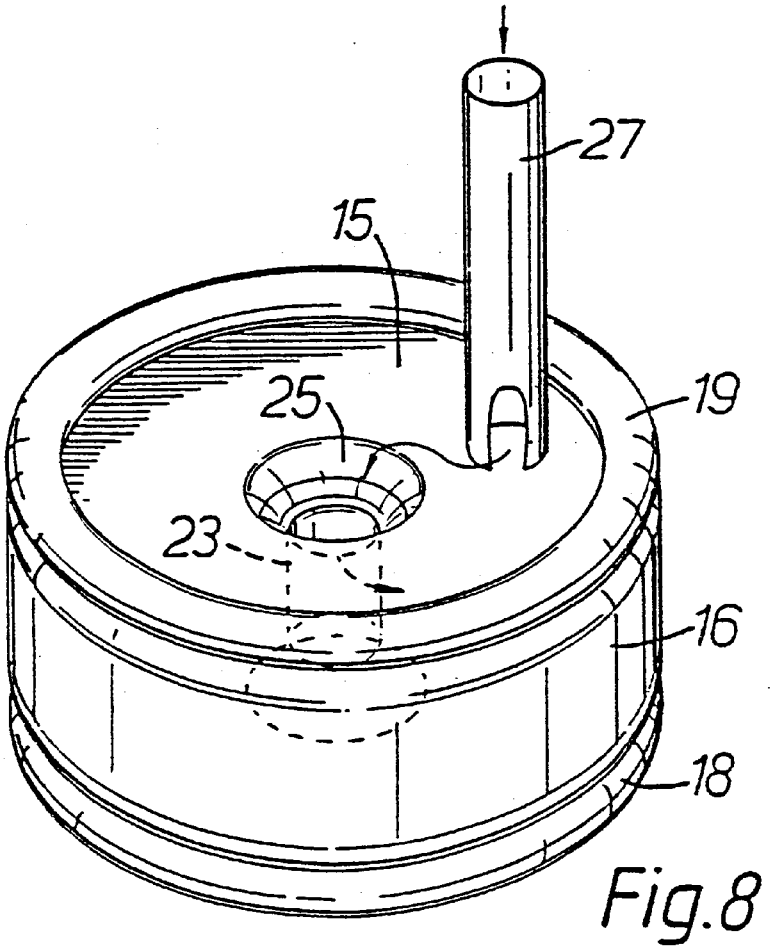
FIG. 8 is a perspective view of the liferaft of FIGS. 6 and 7 in use with a chute-type marine escape system.

As shown in FIG. 8, this concept can be used with a chute-type or slide-type marine escape system. In a chute system, the evacuees pass along a tubular chute 27 and exit through a hole 28 at a lower end of the chute. The chute 27 can be arranged so that its end is located on the sheet 14,15 forming the roof so that evacuees can access the roof and then pass through the tube 23 into the canopy. In a slide system (not shown), the slide is formed by an elongate slide surface with raised sidewalls. The lower end of the slide is located at the tube 23 so that evacuees can pass down the slide and then pass through the tube into the canopy as described above.

The liferafts described above with reference to the drawings are capable of accommodating a large number of persons. In order to do this, the tubes 10,11,18,19 must be of significant size. In order to ensure rapid inflation of such tubes, it may be necessary to have a number of sources of gas under pressure feeding gas to different points of the structure. Alternatively, one source of gas under pressure can have a number of outlets led across the exterior of the structure to different points on the tubes 10,11,12,18,19.

Both of these possibilities, while working adequately, havoc problems. Using a number of separate sources adds to the weight of the liferaft arid running tubes across the exterior of the structure can result in damage to the tubes.

FIG. 7 shows a way of overcoming these difficulties. A single source 36 of gas under pressure is provided with a single inlet 37 into the tube 10. From there, pipes 38 run through the interiors of the tubes 10,11,12,18,19 to feed gas under pressure to zones of the tubes 10,11,12,18,19 remote from the inlet 37. In this way, all parts of the inflatable structure inflate together and inflation is achieved quickly.

It will be appreciated that the liferafts described above with reference to the drawings are highly buoyant because of the number of inflatable tubes they include. This gives significant redundancy in the case of damage. In addition, because they are much wader than they are high, they will almost always deploy in the configuration shown and there will be no tendency for them to deploy on their sides.

It will be appreciated that the liferafts shown in the drawings may be modified in a number of ways. The inflatable structure need not be as shown; it can have any arrangement which supports the sheets in the required configuration so that the liferaft is reversible. For example, the struts 12 could be replaced by a stack of tubes shaped as the tubes 10,11 and extending to a requisite height with circumferential gaps to provide the entrance 17. This is shown in broken line at 40 in FIG. 4. In this case, the wall 16 need not be continuous. Each sheet 14,15 and the walls 16 need not be formed in one piece; each could be formed of a number of pieces.

The term "inflatable" is intended to cover members that can be deployed from a collapsed disposition to a comparatively rigid disposition. This may be by means of a gas but could be by means of foamable materials.

We claim:

1. A liferaft comprising a canopy including two foldable, generally planar members (14,15), the canopy being supported by an inflatable structure (10,11,12) which, when inflated, includes inflatable tubes (12) that hold the planar members in such a spaced configuration that one planar member (14) acts as a floor and the other planar member (15) acts as a roof, or vice versa, an entrance (17;25) being provided for access into the interior of the liferaft in each of the planar members (14).

2. A liferaft according to claim 1 wherein a tube (23) extends between a hole (24) in one planar member (14) and a hole (25) in the other planar member (15), the tube (23) including an entrance (29*a*,29*b*) into the interior of the canopy so that said interior can be accessed by passing along the tube (23) from either end and then passing through the entrance (29*a*,29*b*).

3. A liferaft according to claim 2 wherein the tube (23) includes between the ends thereof, an angled panel (30) such that a person passing through the tube (23) from either end is diverted by the panel (30) into the liferaft, the tube having two entrances (29*c*,29*d*) on diametrically opposite sides of the tube (23).

4. A liferaft according to claim 3 wherein the panel (30) is perforate to allow the passage of water therethrough.

5. A liferaft according to claim 1 wherein the inflatable structure includes at least a first inflatable tubular member (10) surrounding one of said planar members (14) and connected to one side of said planar member (14) and at least a second inflatable tubular member (11) surrounding the other of said planar members (15) and connected to one side of said planar member (15).

6. A liferaft according to claim 5 wherein a single inflatable tubular member (10) surrounds said one planar member (14).

7. A liferaft according to claim 5 wherein a single inflatable tubular member (11) surrounds said other planar member (15).

8. A liferaft according to claim 5 wherein two or more inflatable tubular members (10,18) surround said one planar member (14).

9. A liferaft according to claim 5, wherein two or more inflatable tubular members (11;19) surround said other planar member (15).

10. A liferaft according to claim 5 wherein inflatable tubular members (12;40) extend between said at least one first tubular member (10,18) and said at least one second tubular member (11;19) to separate the planar members (14,15) when the inflatable structure is inflated.

11. A liferaft according to claim 5 wherein at least one further inflatable tubular member (18) surrounds said one planar member (14) and is connected to a side of said one planar member (14) opposite said one side.

12. A liferaft according to claim 5 wherein at least one further inflatable tubular member (19) surrounds said other planar member (15) and is connected to a side of said other planar member (15) opposite said one side.

13. A liferaft according to claim 1 wherein an additional entrance (17) is provided in a wall (16) of the canopy.

14. A liferaft according to claim 13 wherein the entrance includes a vertical panel (16) having an upper edge and a lower edge, the lower edge being connected to a radially outermost portion of the periphery of an inflatable tubular (10) member, to form, between the periphery of the inflatable tubular member and the panel, a channel (30) for the drainage of water.

15. A liferaft according to claim 1 wherein a bridle (34,35) is provided for connecting the liferaft to an adjacent liferaft.

16. A liferaft according to claim 15 wherein the bridle comprises a rope (34) attached to the inflatable structure (10,11) at two vertically spaced points and an eye (35) running on the rope and for connection to said adjacent liferaft.

17. A liferaft according to claim 1 including an inflation system comprising a single source (18) of gas under pressure, an outlet from the source (36) connected to a single inlet (37) to the inflatable structure (10,11,12), the inlet being connected to a plurality of tubes (38) passing through the inflatable structure and opening at spaced points within the inflatable,structure to distribute gas under pressure to said spaced points during inflation.

18. A liferaft according to claim 1 and including a plurality of water pockets (20) associated with each of the planar members (14,15).

19. A liferaft according to claim 1 wherein the inflatable tubes (10,11,12) hold the planar members (14,15) generally parallel.

20. A liferaft according to claim 10 wherein the inflatable tubular members (40) extending between the at least one first tubular member (10;18) and the at least one second tubular member (11;19) have centre lines that lie in planes parallel to said at least one first tubular member (10;18) and said at least one second tubular member (11;19).

21. A liferaft comprising a canopy including two foldable, generally planar members (14,15), the canopy being supported by an inflatable structure (10,11,12) which, when inflated, includes inflatable tubes (12) that hold the planar members in such a spaced configuration that one planar member (14) acts as a floor and the other planar member (15) acts as a roof, or vice versa, an entrance (17;25) being provided for access into the interior of the liferaft, the inflatable structure includes a first inflatable tubular member (10) surrounding one of said planar members (14) and connected to one side of said planar member (14), a second inflatable tubular member (11) surrounding the other of said planar members (15) and connected to one side of said planar member (15), and a stack of tubular,members (40) extending between the first and second tubular member (10) and the second tubular member (11) and lying in respective planes parallel to the planes of the first and second tubular members (11,12).

22. A liferaft according to claim 21 wherein at least one further inflatable tubular member (18) surrounds said one planar member (14) and is connected to a side of said one planar member (14) opposite said one side.

23. A liferaft according to claim 21 wherein at least one further inflatable tubular member (19) surrounds said other planar member (15) and is connected to a side of said other planar member (15) opposite said one side.

24. A liferaft according to claim 21 wherein the first and second inflatable tubular members (10,11) are octagonal.

25. A liferaft according to claim 21 wherein the entrance (17) is provided in a wall (16) of the canopy.

26. A liferaft according to claim 25 wherein the entrance includes a vertical panel (16) having an upper edge and a lower edge, the lower edge being connected to a radially outermost portion of the periphery of an inflatable tubular (10) member, to form, between the periphery of the inflatable tubular member and the panel, a channel (30) for the drainage of water.

27. A liferaft according to claim 21 wherein the entrance (25), or an additional entrance, is provided in each of the planar members (14,15).

28. A liferaft according to claim 27 wherein a tube (23) extends between a hole (24) in one planar member (14) and a hole (25) in the other planar member (15), the tube (23) including an entrance (29*a*,29*b*) into the interior of the canopy so that said interior can be accessed by passing along the tube (23) from either end and then passing through the entrance (29*a*,29*b*).

29. A liferaft according to claim 28 wherein the tube (23) includes between the ends thereof, an angled panel (30) such that a person passing through the tube (23) from either end is diverted by the panel (30) into the liferaft, the tube having two entrances (29*c*,29*d*) on diametrically opposite sides of the tube (23).

30. A liferaft according to claim 28 wherein the panel (30) is perforate to allow the passage of water therethrough.

31. A liferaft according to claim 21 including an inflation system comprising a single source (18) of gas under pressure, an outlet from the source (36) connected to a single inlet (37) to the inflatable structure (10,11,12), the inlet being connected to a plurality of tubes (38) passing through the inflatable structure and opening at spaced points within the inflatable structure to distribute gas under pressure to said spaced points during inflation.

32. A liferaft according to claim 21 wherein the inflatable tubes (10,11,12) hold the planar members (14,15) generally parallel.

* * * * *